US008517038B2

(12) United States Patent
Cannady

(10) Patent No.: US 8,517,038 B2
(45) Date of Patent: Aug. 27, 2013

(54) INSULATED SPORT/UTILITY SHELTER

(75) Inventor: Todd Nelson Cannady, Franklinton, NC (US)

(73) Assignee: Hunter's Comfort, LLC, Franklinton, NC (US)

( * ) Notice: Subject to any disclaimer, the term of this patent is extended or adjusted under 35 U.S.C. 154(b) by 263 days.

(21) Appl. No.: 12/714,859

(22) Filed: Mar. 1, 2010

(65) Prior Publication Data

US 2011/0209734 A1 Sep. 1, 2011

(51) Int. Cl.
*E04H 15/34* (2006.01)
*E04C 1/40* (2006.01)

(52) U.S. Cl.
USPC ..... 135/157; 135/901; 135/900; 52/309.4

(58) Field of Classification Search
USPC ..... 135/900, 901, 157, 115, 120.1; 52/309.4, 52/404.1, 742.13
See application file for complete search history.

(56) References Cited

U.S. PATENT DOCUMENTS 3,698,927 A * 10/1972 Flynn et al. ..... 428/314.4
3,739,536 A * 6/1973 Ward ..... 52/63
5,592,960 A 1/1997 Williams
6,009,673 A 1/2000 Adams
7,188,635 B2 * 3/2007 Johnson ..... 135/87
2006/0048459 A1 3/2006 Moore
2009/0014044 A1 * 1/2009 Hartman et al. ..... 135/143
2009/0204444 A1 * 8/2009 Tucker et al. ..... 705/4
2009/0293396 A1 * 12/2009 Porter ..... 52/309.3
2009/0325445 A1 * 12/2009 Bogdan et al. ..... 442/224

OTHER PUBLICATIONS

EnviroFoam Insulation, Money Isn't All You're Saving, The World's Most Cost Effective, Energy Efficient, and Environmentally Friendly Insulation; http://www.envirofoaminsulation.com/versus.html.
Outer Armour, 2009, http://www.outerarmourusa/chooseus.html.

* cited by examiner

*Primary Examiner* — David Dunn
*Assistant Examiner* — Danielle Jackson
(74) *Attorney, Agent, or Firm* — James G. Passé; Passé Intellectual Property, LLC

(57) ABSTRACT

The present invention relates to an outdoor shelter, such as a hunting blind consisting of a rectangular structure with roof and floor. The outer surface is coated with a spray closed cell foam insulation material, such as spray polyurethane. The foam is coated with a waterproof flexible membrane, such as a waterproof flexible latex paint.

9 Claims, 4 Drawing Sheets

INSULATED SPORT/UTILITY SHELTER

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to an insulated sport or utility shelter. In particular, the present invention relates to an insulated shelter for use as a sport or utility shelter wherein a spray on closed cell foam is applied to the outside of the shelter with a UV film coating.

2. Description of Related Art

Sports enthusiasts as well as those in need of storage have long realized the value of an outdoor small shelter. These shelters take many forms, such as huts, sheds, shanties, hunting blinds, ice fishing shelters, tents, and the like. They are usually constructed very simply out of easy to use materials, including wood, plastic metal, glass, fiberglass, and the like. For sportsmen, it can provide protection from inclement weather and aids in concealment of the sportsman, for example, when using the shelter as a hunting blind.

The construction of these shelters are frequently homemade but even when commercially made are designed very inexpensively, especially, where the shelter is designed to be of a temporary nature or designed to be moved or stored in between uses or after a particular season.

If one considers all the home made versions of these shelters, there are literally hundreds, if not thousands of versions of shelters. They all frequently deal with lightweight even foldable materials that lower weight and costs and create a shelter that's easy to store. However, one of the largest problems is when these shelters are used in cold weather. While the shelter will provide shelter from wind, rain, and snow they provide limited protection against temperatures. Keeping warm in these types of shelters remains very difficult. Typically, they are not ventilated, such that use of inside gas mantle heating or infrared stoves can cause illness or death by asphyxiation. Some types of insulation have also been utilized on the inside of the shelter but accumulation of moisture on the inside and the like is an extreme problem. Other types of insulation are also applied to both the outside and the inside simultaneously, but these have problems with damage to the insulation from sunlight and have moisture problems on the inside of the shelter. The typical home type insulated construction is not practical as adding to much cost and weight. Accordingly, there is still a need for insulated sports shelters that is not adequately taken care of.

U.S. Pat. No. 6,009,673 issued Jan. 4, 2006 to Adams provides an insulated modular enclosure for use as a hunting blind, ice fishing shelter, observatory, and the like. The enclosure comprises a plurality of rigid panels insulated on the inside by closed cell polystyrene to form a shelter with 4 walls, a roof and a floor. The shelter is modular in that members have track members for assembly and includes entrance and shooting openings and the like.

In US patent application 2006/0048459 published Mar. 9, 2006 to Moore, there is disclosed an enclosure constructed of vinyl foam filled blow-molded panels. These panels are structured with tongue and groove connections built in to provide quick interlock one to another without the need for tools in assembly or disassembly.

BRIEF SUMMARY OF THE INVENTION

The present invention relates to an outdoor utility structure, having walls, a roof, and a floor wherein at least a portion of the outer surface of the shelter has a spray closed cell foam sprayed on the outside of the structure followed by a UV resistant membrane coating on the foam. It has been discovered that this construction is warmer in winter and cooler in summer than other construction methods, and is more resistant to insulation damage due to sun and less likely to have moisture inside, the insulation layer or layers than if a shelter is coated on both the outside and inside yet provides as much insulation. By only insulating the outer surface of the walls and roof and not positioning insulation in the inside of any rigid panel, a better insulation is obtained at a cheaper cost than previous methods of insulating an outdoor structure, such as a hunting blind.

Accordingly, one embodiment of the present invention refers to an enclosure having inner and outer surface for outdoor activities having an assembly of panels assembled to construct at least four spaced apart walls and a floor and a roof comprising:

a) at least a portion of an outer surface of one or more wall panels or roof is spay coated with a closed cell spray foam of a least about a half lb. density; and b) wherein the foam is coated with a UV resistant flexible membrane coating and the inner surface of the enclosure is not insulated.

DETAILED DESCRIPTION OF THE INVENTION

Figure 1:
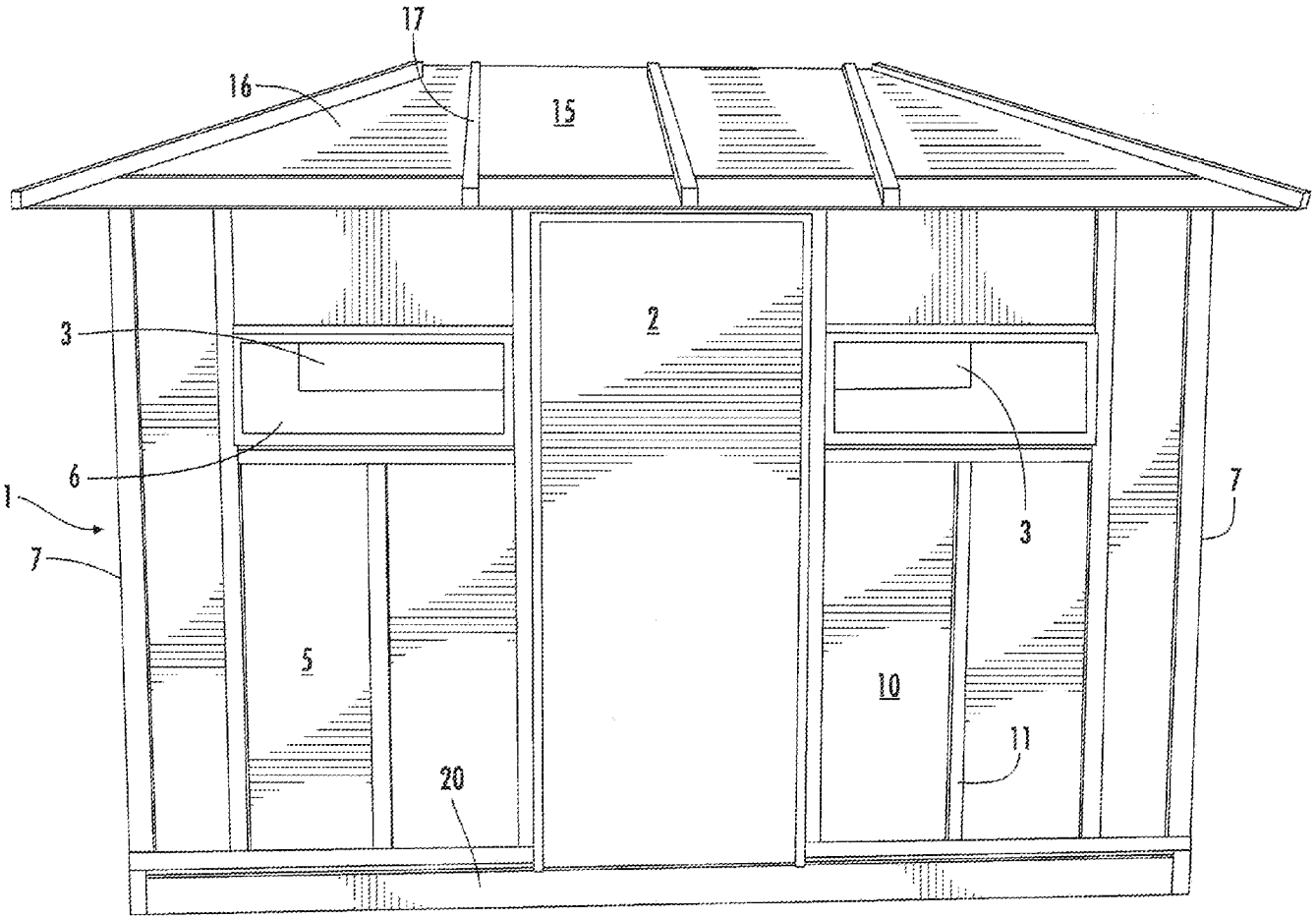
FIG. 1 is a perspective view of a hunting blind embodiment of an enclosure frame having four sides, a roof, and a floor without any insulation.

While this invention is susceptible to embodiment in many different forms, there is shown in the drawings and will herein, be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein, is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein an "enclosure" is a building with four or more (5, 6, 7, 8 or more) sides, a roof and a floor intended for outdoor activity use. The structure can be square, rectangular, octagonal or the like as desired. They are usually portable in the sense that they are small single room buildings with no facilities other than shelter from the elements, in general. They can usually be towed or carried to a location for use, such as for hunting. Storage buildings, huts, sports buildings, such as hunting blinds and the like, come within this definition. They have in common that they are structures not intended for living in and as such, are bare bone structures. One embodiment in particular is a hunting blind which consists of an entranceway, such as a door, windows and/or ports for shooting or observing wildlife. These small enclosures as a group are well known.

As used herein the term "panel" refers to a rigid building material normally used to construct the walls and/or ceiling floors and the like, a small enclosure type building. Typical materials are wood, such as fiber board and plywood, plastic, metal, and the like and usually consisting of thin (quarter to half inch thickness) sheet pieces (e.g. 4 by 8 sheets of plywood) assembled to form walls (front, back and two opposing sides in the case of a four wall structure), roofs and floors. Where wood paneling is utilized, two by fours or other lumber is normally used as framing pieces to support the sheets and give something to attach the sheets to. The inside of the panels in the present invention are not insulated or otherwise treated other than decorative paint or the like. The construction of a frame panel enclosure out of these materials is known within the skill in the art. In one embodiment, however, porous materials, such as wood product panels are selected with lumber framing.

The roof and floor can also be constructed of the same or similar materials. The shape of the roof can be flat or angled as necessary to enable snow and rain to run off the roof and the like. Floor construction is also standard, using the same types of materials as for panels and roof. Both of these constructions are within the skill in the art.

The present invention shelter has insulation sprayed only on the outside of the structure. No insulation is placed other than on at least a position of the outer surface of the panels and optionally outer surface of the roof. So, in other words, where there is no insulation on the inner surface of the wall panels and roof. Possibly, some could be on exposed (outside) portions of the flooring (as seen in the figures), but once again, the inner surface of the walls and roof do not have insulation in the present invention. The insulation selected for the present invention is a spray closed cell foam insulation. Closed cell foam used in the present invention is referred to as a medium density foam and consists of a liquid foam that is sprayed in place with millions of microscopic bubbles which form during expansion of the foam and remain closed and intact as the foam material cures and hardens. Typically, closed cell medium density foam is also considered a two pound density or larger. The most common type of spray foam is a spray Polyurethane closed cell foam, such as EnviroFoam. Other spray polymer foams could be used within the scope of this invention as long as they are a closed cell type foam.

The spray foam is applied to the outer surface of the structure by spraying over any surface of the structure exposed to the elements. While it is not necessary in some embodiments to spray the entire outer surface exposed to the elements, depending on the material used to construct the panels one might consider spraying the whole structure as better insulation than would occur verses only partial covering. The unusual part of the invention in part is the application of this foam to the outside of the structure without having any insulation on the inside of the panel or structure. By avoiding insulation inside the panel or structure, the building becomes more breathable and comfortable to uses than if insulation on the inside or inside and outside is utilized. Accordingly, after the outside is sprayed, no inside insulation is used.

To prevent the sunlight from deteriorating the foam, it is part of the invention to add a thin flexible membrane coating to the surface of any foam applied to a panel or roof. The membrane will be contain a UV resistant material coating that then protects the foam from the UV elements and acts as a thin barrier protecting the foam from minor damage. A latex type paint with a UV resistant additive is such a flexible membrane that could be utilized in one embodiment, however, any liquid applied coating which then dries and/or hardens to form a flexible UV resistant coating could be used. Polymeric paints and the like are cost effective and easy to apply, but other polymers or the like could be applied.

For some sporting uses, such as for a hunting blind, it is useful to build a structure for elevating the enclosure off the ground. Frame wood metal or the like structures for elevating the enclosure can also be incorporated into use and structure of the enclosure of the invention where desired. The elevated structure will have a flat surface for positioning the structure and enough flat surface for giving access to any entrance in the building. Steps or ladders are used to gain access to the platform then. A typical structure of this kind is seen in the drawings.

Now referring to the drawings, FIG. 1 shows an enclosure of the present invention without insulation or membrane coating. In this view, building 1 is a hunting blind having front door 2 window/shooting ports 3 on both the front wall 5 and back wall 6 (only the inside of the wall is seen). The construction of the walls 5 and 6 as well as side walls 7 consists of particle board sheeting 10 mounted inside lumber framing 11. The roof 15 consists of wood sheeting 16 and lumber 17 as well and is angled to slough off water and snow. The edge of floor 20 is seen from a perpendicular edge with the actual flooring inside the building 1 and not seen.

Figure 2:
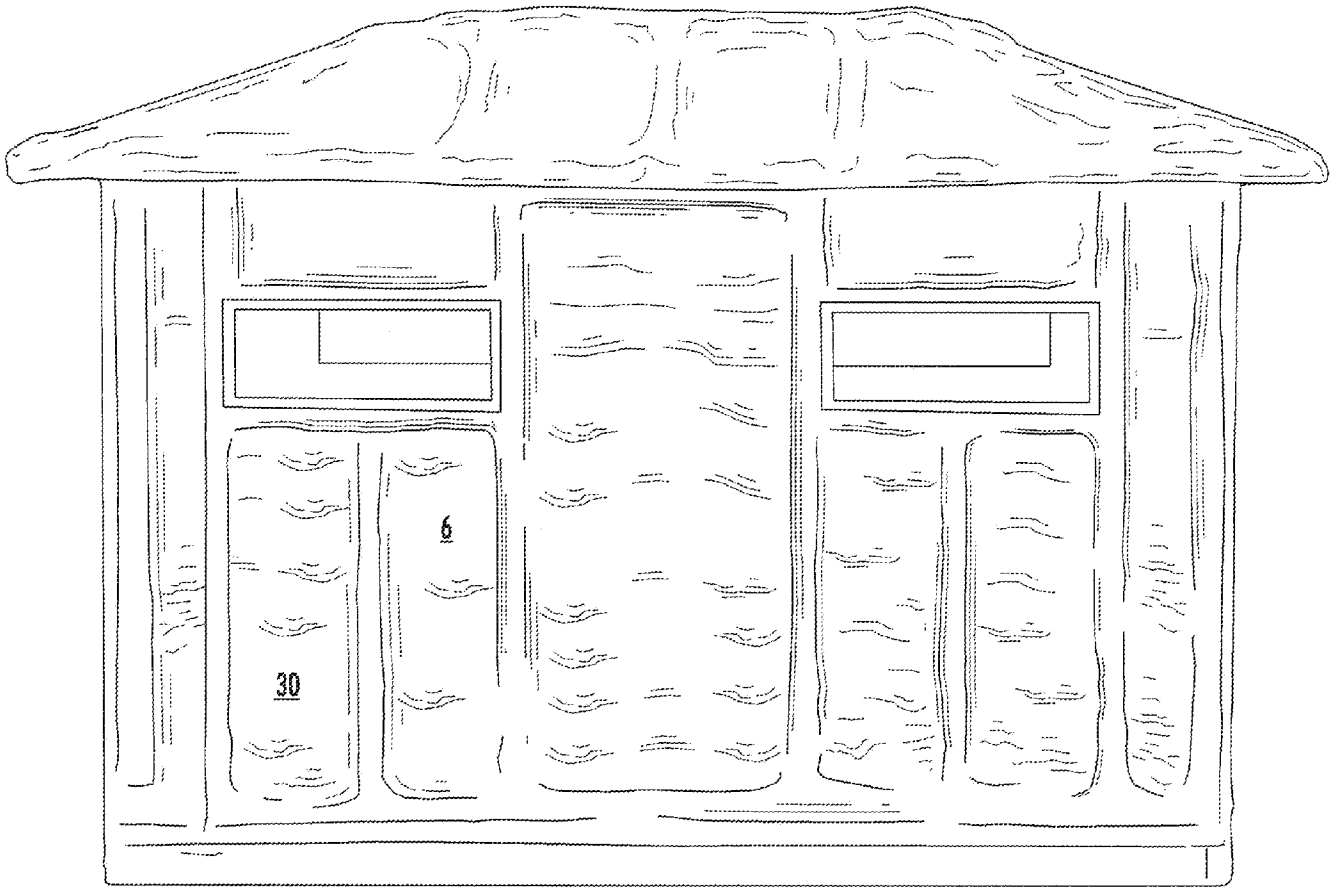
FIG. 2 is a perspective view of a hunting blind enclosure of the invention having a spray foam with UV resistant flexible paint membrane.

FIG. 2 is a perspective view of an enclosure 30 of the present invention. This perspective shows the back wall 6. In this view, a layer of closed cell foam has been sprayed and hardened on all the outside surfaces of the structure followed by a spray on flexible membrane coating, for example, a latex paint with a UV resistant material. The roof and walls are thus coated, and the enclosure is insulated and coated on the outside of the building rather than the usual inside or middle of the walls.

Figure 3:
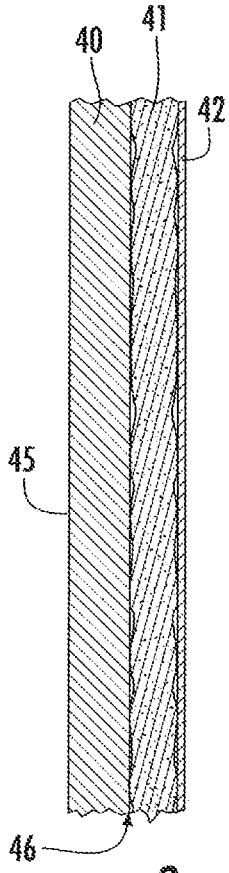
FIG. 3 is a cross section of a panel and foam and membrane layers.

FIG. 3 shows a cross section of a portion of coated panel wall of the present invention. In this view, wall sheet 40 is seen from the side. The inside surface 45 has no coating while the outside surface 46 (which faces the environment) is coated first with a spray closed cell polymeric film 41 and the foam 41 then coated with a flexible UV resistant coating 42.

Figure 4:
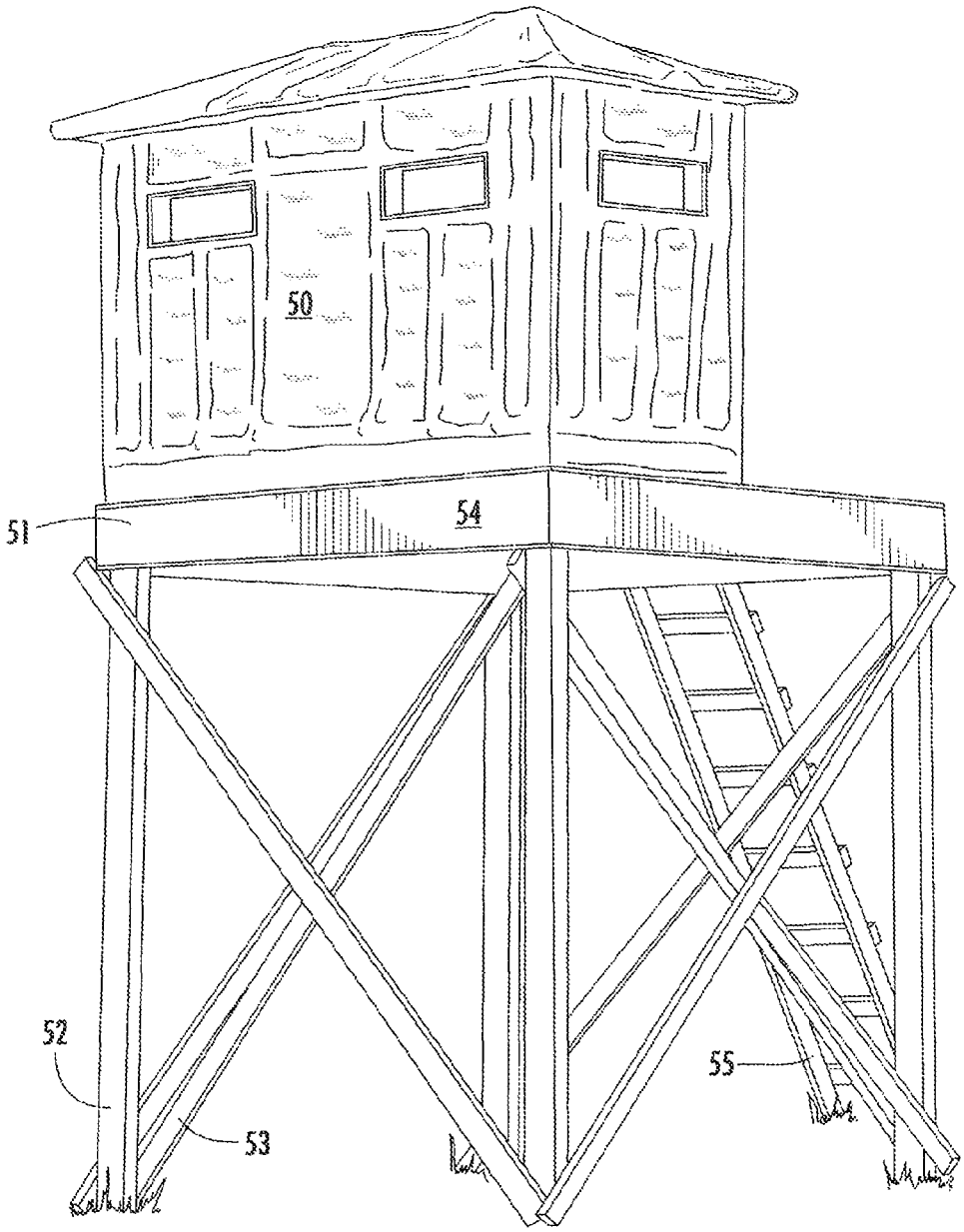
FIG. 4 is a perspective view of the enclosure of the invention on a raised stand.

FIG. 4 depicts a perspective view of an enclosure 50 sitting on a raised stand 51. The stand 51 consist of legs 52, bracing 53, floor 54, and ladder 55. The height is obviously constructed based on desired viewing conditions as well as building materials and the like.

The present invention is not limited to the drawings unless otherwise stated by applicant. The inventor reserves the right to limit the invention to particular embodiments. The claims are to be given the definitions herein, or where no definition is given their plain meaning. Nothing herein, is intended to be limiting on the scope of the claims or otherwise.

What is claimed is:

1. A rigid enclosure for outdoor sporting activities having an assembly of rigid building material assembled to construct the enclosure comprising at least four spaced apart side walls, a floor, a roof, and at least one of a door, a window, and a shooting vent consisting essentially of:

a) panels of a rigid porous material attached to themselves or to a rigid frame to form the walls, floor and roof;

b) an entire outer surface of the walls, floor, and roof are spray coated with a composition consisting of a closed cell spray foam of a least about a two lb. per cubic foot density; and c) wherein the outside surface of the foam is coated with a composition consisting of water-based UV coating and the inner surface of the enclosure is not insulated.

2. The enclosure according to claim 1 wherein the spray foam has a density of from about a 2 lb. per cubic foot density to a 3 lb per cubic foot density.

3. The enclosure according to claim 1 where in the closed cell spray foam is spray polyurethane foam.

4. The enclosure according to claim 1 wherein the panels are constructed of wood or wood product.

5. The enclosure according to claim 4 which comprises a lumber frame.

6. The enclosure according to claim 4 where in the panels are fiberboard or plywood.

7. The enclosure according to claim 1 wherein the panels are a rigid polymer.

8. The enclosure according to claim 1 which further comprises a stand for elevating the enclosure off the ground.

9. The enclosure according to claim 1 wherein the sporting enclosure is a hunting blind.

* * * * *